United States Patent [19]

Eisele et al.

[11] Patent Number: 4,501,248

[45] Date of Patent: Feb. 26, 1985

[54] APPARATUS FOR ASCERTAINING CONTROL VARIABLES IN AN INTERNAL COMBUSTION ENGINE

[75] Inventors: Hermann Eisele, Schwieberdingen; Bruno Frank, Möglingen both of Fed. Rep. of Germany

[73] Assignee: Robert Bosch GmbH, Stuttgart, Fed. Rep. of Germany

[21] Appl. No.: 482,107

[22] Filed: Apr. 4, 1983

Related U.S. Application Data

[63] Continuation of Ser. No. 243,180, Mar. 12, 1981, abandoned.

[30] Foreign Application Priority Data

Mar. 13, 1980 [DE] Fed. Rep. of Germany ..... 3009627

[51] Int. Cl.[3] ..... F02M 51/00

[52] U.S. Cl. ..... 123/478; 123/480; 123/179 G

[58] Field of Search ..... 123/478, 480, 483, 179 G, 123/179 L

[56] References Cited

U.S. PATENT DOCUMENTS

| | | | |
|---|---|---|---|
| 3,835,819 | 9/1974 | Anderson, Jr. | 123/480 |
| 4,197,767 | 4/1980 | Leung | 123/179 G |
| 4,240,382 | 12/1980 | Reddy | 123/478 |
| 4,274,141 | 6/1981 | Tokuda et al. | 123/480 |
| 4,296,722 | 10/1981 | Furuhashi et al. | 123/478 |
| 4,301,780 | 11/1981 | Hoshi | 123/480 |

FOREIGN PATENT DOCUMENTS

| | | | |
|---|---|---|---|
| 0058110 | 5/1979 | Japan | 123/480 |
| 0058117 | 5/1979 | Japan | 123/480 |

*Primary Examiner*—Parshotam S. Lall
*Attorney, Agent, or Firm*—Edwin E. Greigg

[57] ABSTRACT

An apparatus for ascertaining open- and closed-loop control variables of an internal combustion engine, in particular a Diesel engine, on the basis of individual operating characteristics. The individual open- and closed-loop control variables are each ascertained in an individually computer-controlled manner immediately prior to their being needed. This manner of determining the individual values is particularly amenable to realization in large Diesel engines which operate relatively slowly, but it is applicable in principle to all types of internal combustion engines. The proposed apparatus includes an rpm regulator having a subsequent minimum-value selection circuit and calculation circuits for the onset and the duration of injection. Cylinder selection circuits for controlling the rotary direction are also provided. They determine both the particular metering valve being used and the corresponding starting-air valves for controlling the starting process.

For the sake of providing precise fuel metering, the opening duration of the metering valves is made dependent on the fuel pressure prevailing at a particular time. What is of the essence in the apparatus is that the fuel requirement at a particular time is determined immediately prior to the metering thereof, and thus the time required for reacting to changed circumstances is reduced to a minimum.

12 Claims, 3 Drawing Figures

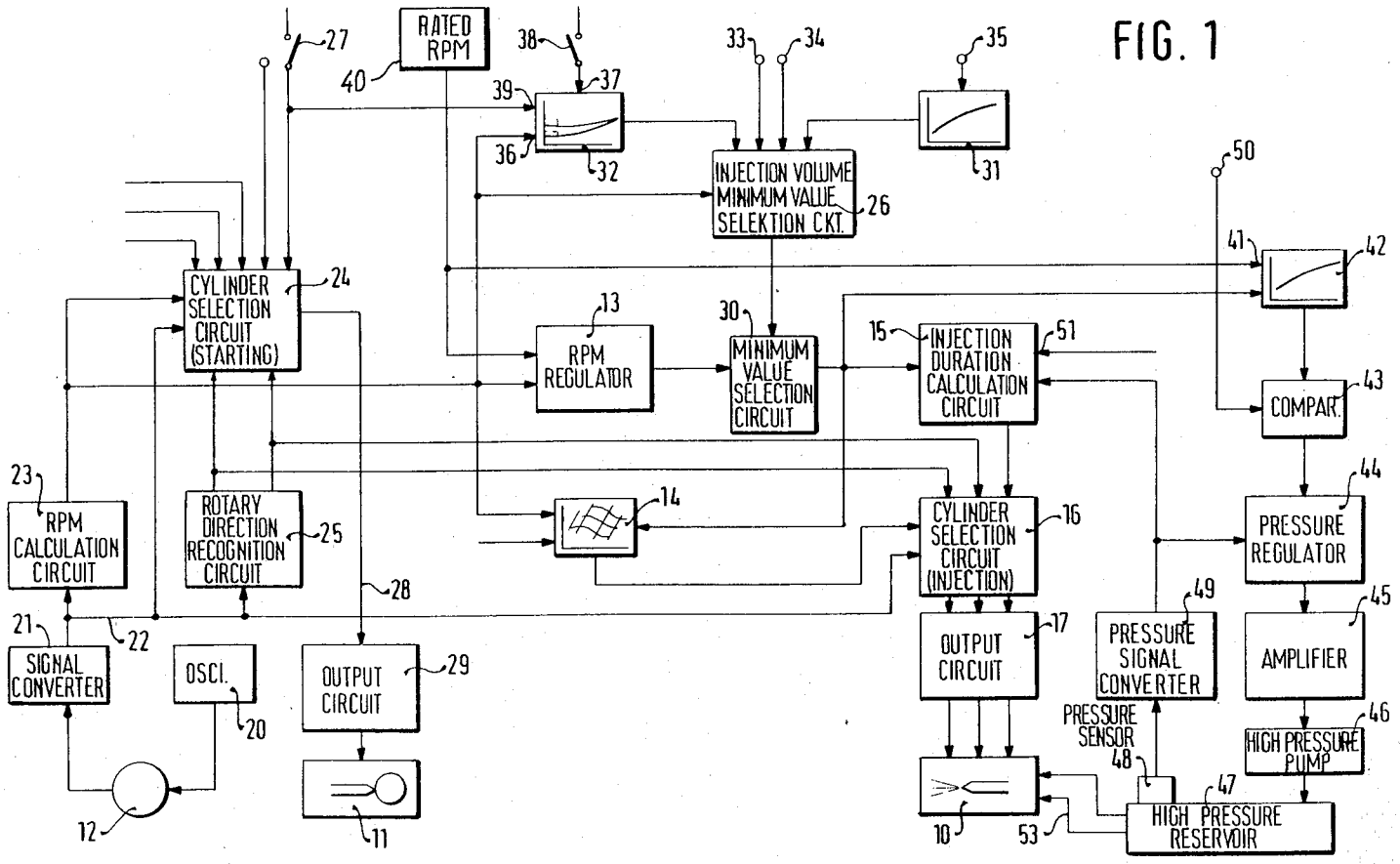
FIG. 1
RATED RPM
INJECTION VOLUME MINIMUM VALUE SELEKTION CKT.
MINIMUM VALUE SELECTION CIRCUIT
RPM REGULATOR
INJECTION DURATION CALCULATION CIRCUIT
CYLINDER SELECTION CIRCUIT (INJECTION)
OUTPUT CIRCUIT
COMPAR.
PRESSURE REGULATOR
AMPLIFIER
HIGH PRESSURE PUMP
HIGH PRESSURE RESERVOIR
PRESSURE SIGNAL CONVERTER
PRESSURE SENSOR
CYLINDER SELECTION CIRCUIT (STARTING)
ROTARY DIRECTION RECOGNITION CIRCUIT
OUTPUT CIRCUIT
OSCI.
SIGNAL CONVERTER
RPM CALCULATION CIRCUIT

APPARATUS FOR ASCERTAINING CONTROL VARIABLES IN AN INTERNAL COMBUSTION ENGINE

This application is a continuation of application Ser. No. 243,180, filed Mar. 12, 1981, now abandoned.

BACKGROUND OF THE INVENTION

The invention relates to electronic control of internal combustion engines.

Although present-day mass-produced Diesel engines have regulators which are virtually exclusively mechanical, the technical literature increasingly describes regulators which are electronically controlled, in which the individual operating characteristics of the engine are input signals of a signal processing unit, and the output variable thereof determines the position of the regulator rod of the injection pump. Increasingly, a computer is called upon as the signal processing unit, because it offers the possibility of manifold variations and applications. Furthermore, purely mechanical valves are used in present-day fuel injection systems, and the quantity of fuel injected depends finally upon the pressure of the fuel which is being made available for injection. Nevertheless, the use of magnetic valves is recommended, especially in Diesel engines which operate relatively slowly, because such valves permit more precise fuel metering. In so doing, injection times are then formed in the signal processing units, and the various injection valves are triggered in accordance with the values ascertained and in synchronism with crankshaft angles. It has been found, however, that the known "global" means of ascertaining trigger signals for the individual electromagnetic injection valves is not sufficient for obtaining a supply of fuel to all the cylinders which is optimal in terms of quantity, and which would thus optimize the engine as a whole.

OBJECT AND SUMMARY OF THE INVENTION

The apparatus described herein includes an electronic computer for ascertaining individual control variables of an internal combustion engine directly before each instant when they are needed. The individual trigger signals can be adapted individually to the requirements of individual cylinders, for instance, and the engine can accordingly function in optimal fashion. The apparatus furthermore enables the separate control of the valves of individual cylinders. This may be advantageous, for instance after a repair has been made to individual elements of the engine, if different cylinders of the engine are to be driven with a differing output.

In a preferred embodiment of the invention, the volume of fuel which is to be metered is determined first, on the basis of the individual operating characteristics, and then the required injection duration is determined in accordance with the prevailing fuel pressure.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a block circuit diagram for the apparatus according to the invention;

DESCRIPTION OF THE PREFERRED EMBODIMENTS

Figure 2:
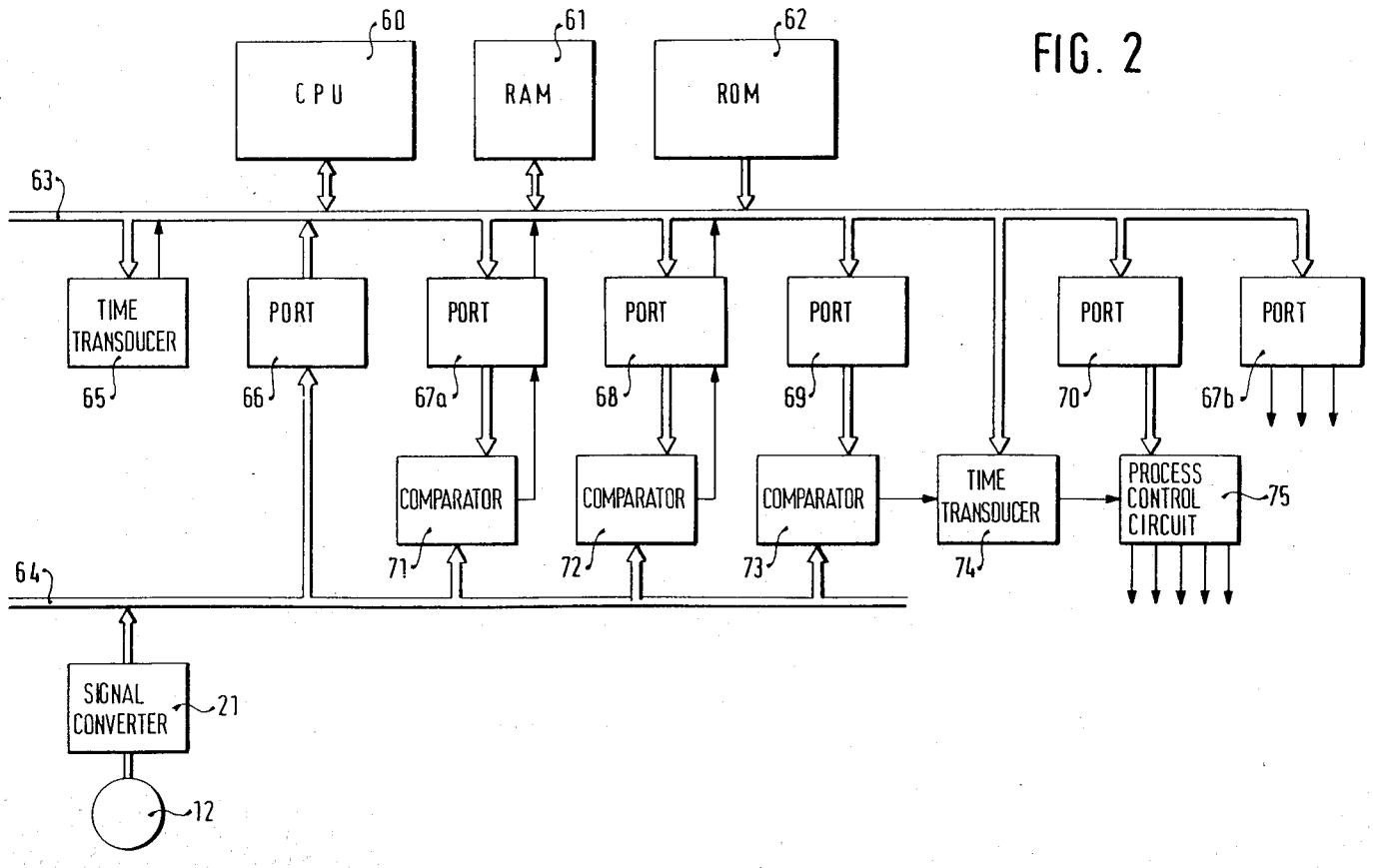
FIG. 2 is an illustration, in block form, of a computer which is known per se but which has been adapted to the requirements of the present invention.

FIG. 1, as a block circuit diagram, illustrates the signal processing apparatus of a Diesel engine having electromagnetic injection and starting-air valves, in which the fuel pressure can be regulated in closed-loop fashion and the rotary direction of the engine can be varied. The internal combustion engine, (not shown), has injection valves 10 and starting-air valves 11 (one each of which is shown in FIG. 1), and a crankshaft angle resolver 12. An rpm regulator 13 (more specifically described in U.S. Application No. 228,399) is followed indirectly by an injection onset control circuit 14 and an injection-duration calculation circuit 15. This calculation circuit 15 is connected in turn on the output side, via a cylinder selection circuit 16 and the individual output circuits 17, with the injection valves 10.

The angle resolver 12 receives an alternating voltage signal from an oscillator 20 and feeds the information on its output side to a distributor line 22 via a signal converter 21. An rpm calculator circuit 23, a cylinder selection circuit for starting 24, a rotary-direction recognition circuit 25, and the cylinder selection circuit for injection 16 are coupled with this distributor line 22. The output of the rpm calculation circuit 23 is connected to the cylinder selection circuit for starting 24, the rpm regulator 13, the injection onset control circuit 14, and an injection-volume minimum-value selection circuit 26 (more specifically described in U.S. Application No. 230,180). Further input variables for the cylinder selection circuit for starting 24 are represented by rotary-direction signals from the rotary-direction recognition circuit 25 and by limit values for the maximum rpm for the onset and end of starting, as well as a value pertaining to the duration of starting, the desired rotary direction, and a signal from a starting switch 27. One line 28 or a multiplicity of lines, depending upon the number of starting valves 11, leads from the output of the cylinder selection circuit for starting 24 to output circuits 29, which are respectively coupled with the magnetic windings of the individual starting valves 11.

A minimum-value selection circuit 30 for selecting the minimum value of a maximum permissible injection volume signal and an injection volume signal predetermined by the rpm regulator 13 is disposed between the rpm regulator 13, which may be embodied as either a P-I-D regulator or as a combination of other regulation algorithms of these individual regulation types, and the injection duration calculation circuit 15. The maximum permissible injection volume signal is obtained thereby from the minimum-value selection circuit 26 for the injection volume. The input variables for this minimum-value selection circuit 26 for injection volume are derived from a first performance graph 31, a second performance graph 32, and two input terminals 33 and 34. At these two terminals 33, 34, maximum value signals for individual cylinders as well as an overall maximum value signal appear. The performance graph 31 contains the maximum permissible injection volume values, dependent upon the exhaust gas composition, for example, or upon the charge-air pressure. The corresponding signals are made available for use via an input terminal 35. In the second performance graph 32, the maximum injection volume values are plotted over the rpm. To this end, one input 36 of the performance graph 32 is connected with the output of the rpm calculation circuit 23. A second input 37 of the performance graph 32 receives signals from a switch 38 for a so-called emergency maneuver. At least two curves for the maximum injection quantity over the rpm are contained in the performance graph 32 itself, with the curve which is disposed lower representing the normal limitation of injection quantity relative to rpm. When an emergency maneuver must be made, as when, by way of example, the internal combustion engine is being used on a ship, this limitation of fuel quantity is effected in accordance with the rubric, "save the ship first, then the engine"; in other words, the limitation is shifted in the direction of greater power, even though this may represent less safety for the engine itself, so that in such emergencies the engine is able to produce increased power. An example of such an emergency would be a braking maneuver involving a reversal of the rotary direction and a high propeller rpm. The performance graph 32 may have an input 36 for the actual rpm and may also be supplied via an input 39 with a signal from the starting switch 27, in order to be able to obtain favorable engine starting behavior even in problematic cases.

A set-point rpm value appears at a further external inut 40 shown as "Rated RPM" having multiple input signals, which may be obtained via a potentiometer, for example, and is delivered to the rpm regulator 13 as well as a first input 41 of a pressure performance graph 42. Particularly in large Diesel engines, close attention must be paid to the fuel pressure in controlling the course of injection.

The performance graph 42 is the first part of a series arrangement comprising the performance graph 42, a pressure regulator 44, an output amplifier 45, a high-pressure pump 46, a high-pressure reservoir 47, a pressure sensor 48 and a pressure signal converter 49. The performance graph 42 further receives a second input value from the output of the comparator 30, and the comparator 43 which follows the performance graph 42 additionally receives a maximum value signal from an external connection point 50. The pressure regulator 44 processes the output signals of the comparator 43 as a set-point value for pressure and processes the output signals of the pressure converter 49 as an actual value for pressure. The output of the pressure converter 49 is additionally connected with one of the inputs of the calculation circuit 15 for the duration of injection.

The pressure regulator 44 may advantageously be followed by a limiter. The injection duration is determined in the calculation circuit 15 in accordance with the formula $$ED = \frac{EV}{C \cdot \sqrt{PE}}$$

where ED indicates the duration of injection, EV indicates the volume injected, pE indicates the injection pressure, and C is an engine constant which is delivered to the calculation circuit 15 via an input 51. The calculated value for the duration of injection is supplied to the cylinder selection circuit for injection 16, which is additionally supplied with a rotary-direction recognition signal from the corresponding rotary-direction recognition circuit 25 and an angle signal for the injection onset from the performance graph 14 and an angle signal from the line 22. This cylinder selection circuit 16 is made up of logic elements and it influences the subsequent output circuits 17 in the desired sequence, at the ascertained onset of injection and for the calculated duration. The supply of fuel to the injection valves 10 is effected via a pressure line 53 from the high-pressure reservoir 47.

What is essential in the subject of FIG. 1 is the sequential calculation of the duration and the onset of injection for one particular cylinder at a time, as well as the control of the cylinder sequence and the regulation of pressure.

The rpm regulator 13 determines an injection volume signal in accordance with the set-point and actual values for rpm, and this injection volume signal is subsequently compared with various maximum fuel quantity signals, serving the purpose of calculating both the injection duration and the onset of injection. These two values (injection duration and injection onset) are finally, via the cylinder selection circuit 16, applied for the purpose of controlling the electromagnetic injection valves 10. The injection processes are triggered upon the appearance of a predetermined crankshaft angle, which in turn characterizes one particular cylinder representing a standard at that particular instant.

A corresponding cylinder selection circuit for starting is switched previous to the output circuits for the starting-air valves 29, by way of which compressed air is introduced into the individual cylinders, as an aid to starting. The control of the starting-air valves is achieved by way of the cylinder selection circuits, 24, namely, for safety reasons only when the rpm of the engine registers between two characterized variables for the beginning and end of start, and as far as a preselected duration of the starting process has not been exceeded.

The crankshaft angle position is detected by means of a crankshaft angle position sensor 12. Its output signal corresponds to the angular position of the crankshaft or some other engine shaft actually existing at the time, independently of the rpm and thus when the engine is in a state of rest as well. These resolvers have long been known and are available on the open market.

The block diagram of FIG. 1 illustrates the various closed-loop control procedures and calculation procedures of the apparatus according to the invention. The individual blocks do not present one of average skill in the art with any problems relating to the realization thereof, because the functions of these individual blocks are narrowly defined and relatively simple.

In view of the desired and increasingly common computerized control of individual operating characteristics, FIG. 2 is a block circuit diagram of a computer having input and output units essential to the subject of the invention.

In FIG. 2, the CPU (central processing unit) is indicated by reference numeral 60, a RAM by 61 and a ROM by 62. All three units communicate with a bus 63, which includes data lines, address lines, and control lines. A second bus 64 is fed with crankshaft angle signals by the rotational indicator or resolver 12 via the converter 21. A time transducer 65, six ports 66–70, three comparators 71–73 and a second time transducer 74 and a process control circuit 75 are indicated in the drawing between the two busses 63 and 64. The individual ports are connected with bus 63 and the comparators are connected with bus 64 and with the individual ports 67–69.

The first time transducer 65 serves the purpose of clocked control of the computer, and by means of an interrupt signal at fixed time intervals it starts an rpm-detection program. In this part of the program, the crankshaft angle is read in from bus 64 via port 66. An rpm-proportional value is obtained in combination with a time signal, as the result of differentiation with the foregoing angular value. The newest rpm value formed at a particular time is continuously available for use in the newest calculation procedures at a particular time, so that the results of calculation are always adapted to the most recently obtained values.

Port 67*a*, in combination with the comparator 71, serves to control the starting-air valves for the starting procedure. A particular angular value is thereby emitted via port 67*a*. If the crankshaft angle on bus 64 attains this value, then an interrupt program 2 is started by the comparator 71. In this part of the program, the appropriate starting-air valves are opened or closed via port 67*b* and via output stages not shown. Finally, the next trigger angle is calculated, adapted to the instantaneous rpm, the number of cylinders, and so forth, and this value is emitted via port 67*a* at the end of this part of the program. In the next corresponding angular position of the crankshaft, a new program start is then effected, and the next starting-air valve is opened or closed.

The control of the starting-air valves at the onset of starting and the first trigger angle are calculated via a separate program. To this end, the crankshaft angle must be read into the system even when the engine is not running. Further, with the onset of the starting procedure and shut-off engine the starter valves will have to be brought into a defined position dependent upon the then prevailing constant crankshaft angle. This requires a separate program which is only used during the starting procedure.

The regulator program for regulating the rpm is started by the comparator 72 at an angle predetermined via the port 68. This is effected shortly before each new injection. The regulator program additionally effects the injection time in accordance with various parameters, for instance the rpm rated and actual value variations. As a result of the specialized detection of rpm, a rapid regulator (for instance a P-regulator) having less precision and a slower regulator (for instance, an I-regulator) having high precision can be simulated. In addition, special operating parameters such as the starting instant, limit values and the like can also be taken into consideration, as discussed above in connection with FIG. 1. The calculated injection time is then loaded into the time transducer 74 via a line 77.

In accordance with what is shown in FIG. 1, the onset of injection depends on the injection quantity signal and on the rpm. Further parameters are naturally also possible. This angular value of the injection onset is applied to the comparator 73 via port 69. Port 70 serves the purpose of cylinder selection or of the selection of the particular injection valve representing a standard at a particular time. If the comparator 73 responds to an agreement between the calculated angular value and the actual angular value, then the time transducer 74 is started, and an injection pulse for a particular injection valve is emitted via the process control circuit 75. When there is a great number of cylinders, it may become necessary to have several of this portion of the circuitry in view of the overlapping which may possibly occur.

At the end of this part of the program, the next trigger angle is loaded via port 68, and then in turn the next regulator program is started upon the appearance of this angle.

In an efficient manner, the rpm-detection program is given the highest priority in the interrupt programs. The second priority is assigned to controlling the starting-air valves, and the regulator program has third priority. With this interrupt sequence, there are no time delays in the rpm detection or in the control of the injection valves. The delay in controlling the starting-air valves is negligibly brief.

The crankshaft angle signal on bus 64 may be generated by various transducers. Mentioned by way of example are an rpm indicator having an analog-digital converter, an optial encoding transducer, and an incremental transducer having a counter.

The input and output of set-point values, starting and stopping signals, limit values, indicator values and the like is effected via further ports. They are not shown in FIG. 1, because this is effected in a manner known to one skilled in the art.

Figure 3:
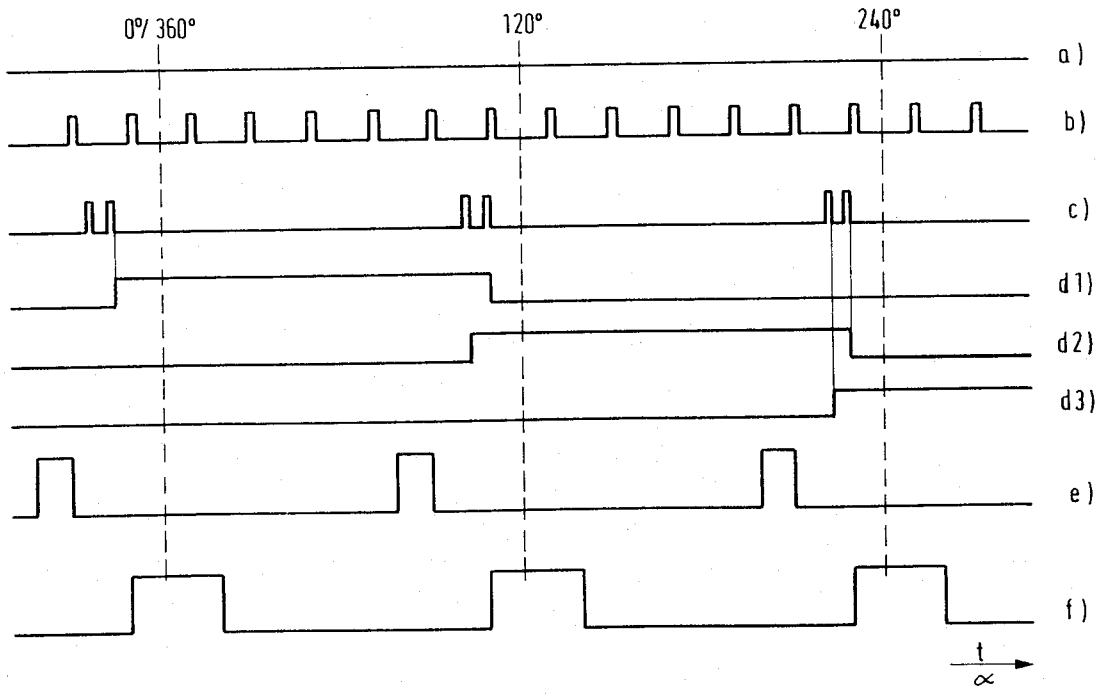
FIG. 3 is a pulse diagram explaining the courses taken by the individual processes.

FIG. 3 is a process diagram for the circuits of FIGS. 1 and 2.

In FIG. 3*a*, the crankshaft angle and the top dead center of the individual cylinders of a three-cylinder engine are plotted.

FIG. 3*b* shows a time-controlled rpm-detection program having program intervals which are constant in time.

The appearance of the starting-air valve control programs is shown in FIG. 3*c*. In the simplest instance, these programs consist solely of the call-up and storage in memory of particular angular positions. However, they may also encompass signal processing, in order to control the starting-air valves in accordance with rpm, for example.

The following three curves d1, d2 and d3 characterize the appearance of the individual starting-air valve control pulses and the relationship in terms of time with the starting-air valve control programs shown in FIG. 3*c*. What is of the essence here is that the ongoing program at a particular time determines the onset of the next program.

FIG. 3*e* shows the appearance of the regulator program, plotted over the crankshaft angle, and here again the foregoing regulator program specifies the onset of the next program.

Finally, FIG. 3*f* shows the relationship of the injection pulses to the top dead center of the individual pistons. It must be assured in this respect that the end of one regulator program occurs in each instance before the angular position pertaining to the earliest-possible injection onset is attained.

A comparison of the two curves shown in FIG. 3*e* and 3*f* clearly illustrates the relationship between the necessary computation times for the regulator program and the injection times. According to this illustration, the regulator device has sufficient time, between the end of one injection pulse and the onset of the next, to calculate the duration and the onset of injection. This illustrates the particularly good applicability of the apparatus especially in the case of relatively slow internal combustion engines, which is especially true of large Diesel engines. When the calculation time is sufficiently short, the apparatus according to the invention can also, however, be used in engines which do not operate so slowly, and the fuel type is not a critical factor; in other words, it can be used in both Diesel and gasoline engines. Furthermore, this arrangement can also be used in principle in Otto engines having one carburetor per cylinder and in gas engines, being adapted to prevailing requirements.

The primary advantage of the apparatus according to the invention resides in the mutually adapted calculation which it provides of the metering duration and the metering onset. It will naturally be understood that these apparatuses permit an extremely rapid reaction of the internal combustion engine to changing circumstances.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for computing nominal value signals for fuel metering and for starting procedure, at least one of values for fuel metering onset, fuel metering duration and switching points of starting airvalves, and for individual cylinders in an internal combustion engine, particularly a Diesel engine comprising means for generating measurement results to individual operating parameters of said engine, computer means for computing said nominal value signals for each said individual cylinder responsive to said measurement results of said generating means wherein the nominal value signals for the nth combustion process of said internal combustion engine and for one of said individual cylinders are computed in the period of time between the (n−1)th and nth combustion process of said internal combustion engine and, output means responsive to said nominal value signals for controlling the operating parameters of said engine.

2. An apparatus as defined by claim 1, wherein said nominal value signals for the metering duration and the metering onset are computed in accordance with a fuel volume to be metered.

3. An apparatus as defined by claim 2, wherein the calculation of the injection duration is effected in accordance with fuel pressure.

4. An apparatus as defined by claim 2, which further comprises a minimum-value selection circuit connected to receive, as one input variable, a calculated fuel volume value and to receive further input variables comprising pre-selectable fuel volume limit values dependent upon various parameters, for example, engine exhaust gas, charge-air temperature and engine-related and cylinder-related data.

5. An apparatus as defined by claim 4, which further comprises an emergency-maneuver switch, and wherein said permissible limit values are dependent on the switching status of said emergency-maneuver device.

6. An apparatus as defined by claim 1, which further comprises a cylinder selection circuit for controlling the rotary direction of the engine.

7. An apparatus as defined by claim 1, wherein said computer means comprises respective sub-program means for the control of the starter valve of the fuel metering for determining the start of the subsequent respective sub-program means.

8. An apparatus as defined by claim 1, wherein said means for generating said nominal value signals includes rpm detecting means for detecting the engine rpm at intervals which are constant in terms of time.

9. An apparatus as defined by claim 1, wherein said means for generating said nominal value signals includes means for determining the injection onset as an angular variable relating to fixed angular positions of the engine crankshaft of said engine.

10. A method for computing nominal value signals for fuel metering and for starting procedure, at least one of values for fuel metering onset, fuel metering duration and switching points of starting airvalves, and for individual cylinders in an internal combustion engine, particularly a Diesel engine comprising the steps of generating measurement results to individual operating parameters of said engine, computing said nominal value signals for each said individual cylinder in response to said measurement results, wherein the nominal value signals for the nth combustion process of said internal combustion engine and for one of said individual cylinders are computed in the period of time between the (n−1) and nth combustion process of said internal combustion engine, and controlling the operation parameters of said engine in response to said nominal value signals.

11. A method according to claim 10, wherein said duration of fuel metering is computed in accordance with fuel pressure.

12. A method according to claim 10, wherein said injection onset is computed as an angular variable relating to fixed angular positions of the engine crankshaft of said engine.

* * * * *